US011506460B1

(12) United States Patent
Fuller et al.

(10) Patent No.: US 11,506,460 B1
(45) Date of Patent: Nov. 22, 2022

(54) MULTI-MODAL GAS BLOCKS FOR GAS PISTON-OPERATED FIREARMS

(71) Applicant: Fuller Phoenix, LLC, Scottsdale, AZ (US)

(72) Inventors: Jim Fuller, Phoenix, AZ (US); Leif Strom, Scottsdale, AZ (US); Kevin Yang, Scottsdale, AZ (US)

(73) Assignee: FULLER PHOENIX, LLC, Scottsdale, AZ (US)

( * ) Notice: Subject to any disclaimer, the term of this patent is extended or adjusted under 35 U.S.C. 154(b) by 0 days.

(21) Appl. No.: 17/328,307

(22) Filed: May 24, 2021

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/26; F41A 5/28
See application file for complete search history.

(56) References Cited

U.S. PATENT DOCUMENTS 1,366,863 A * 1/1921 Berthier ..... F41A 5/28 89/193
1,431,059 A 10/1922 Sutter
1,802,816 A * 4/1931 Emanuel ..... F41A 5/28 89/193
2,750,849 A * 6/1956 Harvey ..... F41A 5/28 89/193
2,783,685 A * 3/1957 Green ..... F41A 5/28 89/193
3,680,434 A * 8/1972 Muhlemann ..... F41A 5/28 89/193
7,891,284 B1 * 2/2011 Barrett ..... F41A 5/28 89/193
7,934,447 B2 5/2011 Kuczynko et al.
8,607,688 B2 12/2013 Cassels
8,640,598 B1 2/2014 Jackson
8,960,069 B1 2/2015 Soong et al.
9,273,916 B1 * 3/2016 Russo ..... F41A 5/28
9,372,039 B1 * 6/2016 Russo ..... F41A 5/28
9,459,061 B2 10/2016 Cassels
9,506,704 B2 11/2016 Gomez
9,816,769 B1 * 11/2017 Brown ..... F41A 5/28
9,995,546 B2 6/2018 Schilling et al.
(Continued)

FOREIGN PATENT DOCUMENTS

GB 604116 A * 1/2013

*Primary Examiner* — Gabriel J. Klein
(74) *Attorney, Agent, or Firm* — Klintworth & Rozenblat IP LLP

(57) ABSTRACT

Multi-modal gas blocks utilized in conjunction with gas piston-operated firearms are disclosed, as are firearms equipped with such gas blocks. In embodiments, the multi-modal gas block includes a gas block body, a valve element cavity, a gas inlet port through which the valve element cavity is fluidly coupled to a barrel bleed port of a firearm, a gas exhaust port fluidly coupled to the valve element cavity, and a gas return port fluidly coupling the valve element cavity to a gas piston cylinder contained in the firearm. A valve element housed within the valve element cavity is movable between: (i) a first position in which the valve element blocks gas flow from the gas inlet port to the gas exhaust port; and (ii) a second position in which the valve element divides gas flow received at the gas inlet port between the gas return and gas exhaust ports.

20 Claims, 9 Drawing Sheets

(56) References Cited

U.S. PATENT DOCUMENTS

| | | | | |
|---|---|---|---|---|
| 10,816,288 | B1 * | 10/2020 | Oglesby | F41A 5/28 |
| 11,280,567 | B1 * | 3/2022 | Hart | F41A 5/28 |
| 2009/0229454 | A1 * | 9/2009 | Fluhr | F41A 5/26 89/193 |
| 2010/0218671 | A1 * | 9/2010 | Mayberry | F41A 5/28 89/192 |
| 2014/0224114 | A1 * | 8/2014 | Faxon | F41A 5/28 89/193 |
| 2014/0260947 | A1 | 9/2014 | Gomez | |
| 2015/0241149 | A1 | 8/2015 | McMillen, IV | |
| 2016/0178299 | A1 | 6/2016 | Cassels | |
| 2020/0025477 | A1 * | 1/2020 | Williams | F41A 3/66 |
| 2020/0025478 | A1 * | 1/2020 | Bandurko | F41A 5/24 |

* cited by examiner

MULTI-MODAL GAS BLOCKS FOR GAS PISTON-OPERATED FIREARMS

TECHNICAL FIELD

The following disclosure relates to firearms and, more particularly, to multi-modal gas blocks utilized in conjunction with gas piston-operated firearms equippable with suppressors, as well as to firearms including such multi-modal gas blocks.

BACKGROUND

As appearing herein, the term "gas piston-operated firearm" refers to a firearm containing a gas block, a gas piston, and a gas piston cylinder in which the gas piston translates or slides. By common design, the gas piston is normally maintained in a forward starting position by a carrier spring, which acts on the gas piston through an intervening bolt carrier. When the gas piston-operated (GPO) firearm is discharged, rapidly-expanding combustive gasses propel a projectile through the firearm barrel. A fraction of this high velocity gas flow is bled from the firearm barrel, routed through the gas block positioned above the barrel, and ultimately delivered into the gas piston cylinder. Introduced into the gas piston cylinder, the expanding gasses act on the exposed face of the gas piston to force the gas piston, as well as the associated bolt carrier and bolt, to slide in a rearward direction toward the gun operator, compressing the carrier spring and ejecting the newly-spent magazine casing from the firearm receiver. The gas piston, the bolt carrier, and the bolt then travel in a forward direction as the carrier spring expands, returning these components to their respective starting positions, while drawing a new magazine cartridge into the firearm receiver. During this sequence of events, the trigger is also reset to its original position by action of a torsion spring, with a sear maintaining the trigger in a depressed position until the GPO firearm is again ready to discharge the next projectile. GPO firearms have gained widespread adoption due, in large part, to the exceptional reliability and cost effective manufacture of such gas piston-based mechanisms. The AK-47 designed by Mikhail Kalashnikov in the Soviet Union in the late 1940s remains the most universally recognized and widely distributed GPO firearm to the present day.

BRIEF DESCRIPTION OF THE DRAWINGS

At least one example of the present invention will hereinafter be described in conjunction with the following figures, wherein like numerals denote like elements, and.

Figure 1:
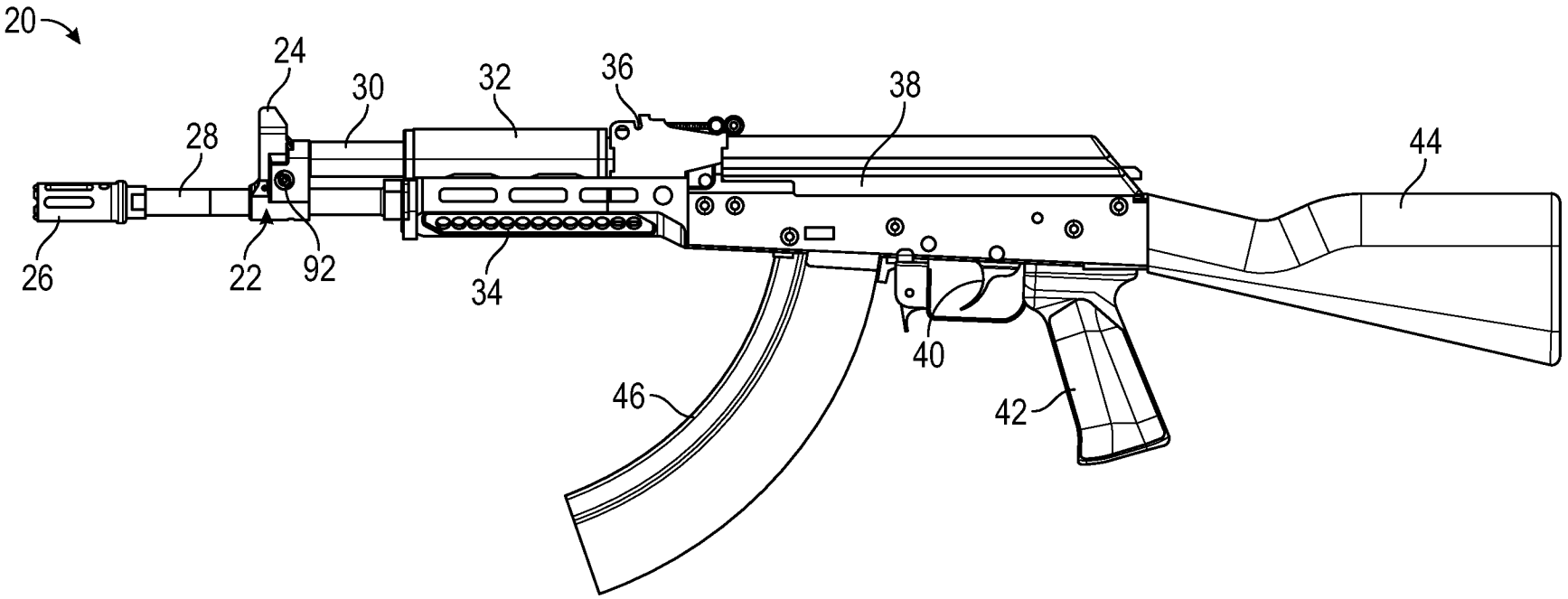
FIG. 1 is a first side view of a gas piston-operated (GPO) firearm and a multi-modal gas block, as illustrated in accordance with an example embodiment of the present disclosure.

For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

The following Detailed Description is merely example in nature and is not intended to limit the invention or the application and uses of the invention. Furthermore, there is no intention to be bound by any theory presented in the preceding Background or the following Detailed Description.

Overview

As discussed briefly above, gas piston-operated (GPO) firearm platforms, particularly AK-47 platforms, have gained widespread global adoption due, in substantial part, to the exceptional reliability and amenability to cost effective manufacture offered by such firearm platforms. Considerable efforts have been expended in designing GPO firearm platforms to achieve optimal gas flow rates and internal pressures during the gas piston-driven projectile discharge, casing ejection, and cartridge rechambering sequence. By maintaining peak flow rates and internal pressures within optimal ranges, stress and wear on gas-exposed components is minimized, while rearward sliding movement of the gas piston, the bolt carrier, and the bolt occurs in a controlled and predictable manner across repeated firearm discharges. When a suppressor is attached to the barrel of a GPO firearm, however, internal pressures and gas flow rates within the GPO firearm inexorably increase, often to undesirably high, operationally-impactful levels. This is particularly true when considering the return gas flow bled from the firearm barrel, routed through the gas block, and ultimately fed into the gas piston cylinder to act upon the gas piston. Over time, stress and wear on the gas-exposed components of the GPO firearm may be exacerbated due to repeated exposure to such elevated pressures and gas flow rates. Concurrently, the rearward velocity imparted to the gas piston, bolt carrier, and bolt when the firearm is discharged also increases, with this force ultimately transferred to the firearm operator in the form of a more pronounced recoil or kickback. Such an increase in recoil force may detract from operator comfort and potentially reduce operator aiming accuracy, particularly when the GPO firearm is discharged multiple times in rapid succession. As a still further drawback, suppressor usage may trap greater volumes of gas-entrained contaminants within the GPO firearm hastening contaminant build-up and necessitating more frequent operator cleaning of the GPO firearm.

Addressing the limitations set-forth above, the following discloses unique, multi-modal gas blocks well-suited for usage in conjunction with GPO firearms selectively equipped with suppressors. In contrast to conventional gas blocks, and as indicated by the term "multi-modal," embodiments of the multi-modal gas block are operable in at least two discrete modes or operative settings: (i) an unsuppressed mode for usage when the GPO firearm is operated without a suppressor (also referred to as operation of the GPO firearm "in an unsuppressed state"), and (ii) a suppressed mode for usage when the GPO firearm is equipped with a suppressor. When placed in the unsuppressed mode, the multi-modal (MM) gas block routes all or substantially all gas flow bled from the firearm barrel into the gas piston cylinder to drive operation of the firearm as previously described. The MM gas block thus supports firearm operation in a manner similar to or substantially identical to a conventional gas black, thereby maintaining consistency in performance and promoting operator familiarity, when the gas block is switched into the unsuppressed mode and the GPO firearm is utilized without a suppressor. Comparatively, when switched into the suppressed mode by the firearm operator, the MM gas block does not route all return gas flow to the gas piston cylinder, but rather vents or exhausts a controlled fraction of the return gas flow to the external environment of the GPO firearm (also referred to herein as "atmosphere"). Such controlled venting of the MM gas block, when properly tailored through dimensioning of one or more flow restrictions within the MM gas block, may effectively offset the increase in internal pressures and flow rates otherwise occurring in conjunction with discharge of the GPO firearm when equipped with a suppressor.

The particular design and construction of the MM gas block will vary between embodiments, providing the MM gas block is operable in an unsuppressed mode and at least one suppressed mode as described throughout this document. This stated, the MM gas block will typically include a main housing or "gas block body" in which a valve element cavity, a primary gas return path, and various ports are formed. The gas block body can be fabricated from any number of discrete components or pieces, but is advantageously produced as a unitary structure by, for example, machining of a metal preform or blank. Regardless of the particular manner in which the MM gas block is produced, the MM gas block includes a number of ports (gas inlets and outlets) to route gas flow bled from the barrel of a GPO firearm through the gas block and to a gas piston cylinder, while also enabling controlled venting of the return gas flow when the gas block is switched into the suppressed mode of operation. These ports include: (i) a gas exhaust port, which may be formed in a sidewall portion of the gas block body in embodiments; (ii) a gas inlet port, which is positioned and sized to receive gas flow from the barrel bleed port of a GPO firearm when the MM gas block is installed thereon; and (iii) a gas return port, which is positioned and sized to fluidly connect to an inlet of a gas piston cylinder when the MM gas block is installed on the GPO firearm. The gas inlet port and the gas return port are fluidly connected by the primary gas return path, which directs gas flow bled from the firearm barrel and received at the gas inlet port to the gas return port for injection into the gas piston cylinder of the GPO firearm. Additionally, the primary gas return is further fluidly coupled to the gas exhaust port through the valve element cavity, in embodiments of the gas block. Such a flow routing architecture enables venting of a controlled fraction of the return gas flow conducted along the primary gas return path through the gas exhaust port and to atmosphere, as determined by the positioning of a valve element within the valve element cavity.

In embodiments, the valve element contained in the MM gas block cooperates within the gas block body to effectively form a three way, multi-position valve; noting that, in certain implementations, the gas block body or housing may also incorporate a sleeve or a similar structural element surrounding the valve element in whole or in part. As a more specific example, in embodiments in which the valve element is movable into first and second discrete or indexed positions corresponding to the unsuppressed and suppressed modes, respectively, the valve element and the gas block body may combine to yield a three way, two position valve. The valve element itself can assume any form suitable for aiding in selectively routing gas flow conducted through the gas block body along a primary flow return path in the manner described herein; noting that, in certain cases, the valve element may assume the form of a translating spool or shuttle, which can be manually toggled between discrete positions by depressing one or more buttons, or otherwise interacting with an operator-manipulated feature, accessible from the exterior of the MM gas block. Further, in at least some implementations, the valve element is conveniently provided in the form of a generally cylindrical rotatable body in which one or more flow channels are formed. For example, in such instances, the generally cylindrical valve element or "rotatable valve cylinder" may include a radial flow channel and an axial flow channel, which intersect at a predetermined angle (e.g., about a 90 degree angle) to allow gas flow through the valve element from the primary flow return path to the gas exhaust port when the valve element is rotated into a position corresponding to the suppressed mode of the MM gas block.

Discussing further embodiments in which valve element is realized as a rotatable valve cylinder, the MM gas block may also include a retention member for engaging the valve cylinder to retain the rotatable valve cylinder within the valve element cavity, while permitting rotation of the valve cylinder between discrete or stable positions. Such a retention member may assume the form of a retention pin in embodiments, with the retention pin secured within a cylindrical cavity formed in the gas block body; e.g., as an example, the retention pin may threadably engage a bore extending into the gas block body from a backside surface or trailing face of the gas block and intersecting the valve element cavity at a predetermined angle, such as a 90 degree angle. When the MM gas block is fully assembled, a non-threaded shaft portion of the retention pin may engage in an arc-shaped or peripheral groove extending at least partially around an outer periphery or circumference of the rotatable valve cylinder. The retention pin may thus retain the rotatable valve cylinder in its desired position within the gas block body by preventing withdrawal of the valve cylinder from the valve element cavity absent operator removal of the retention pin. Concurrently, the retention pin permits rotation of the valve element about its centerline and between discrete positions as the non-threaded shaft portion of the retention pin travels in the peripheral groove formed about the rotatable valve cylinder. Additionally, in embodiments, the peripheral groove may extend only partially around the rotatable valve cylinder and thus possess terminal ends, which contact the retention pin to provide a hard stop interface limiting the angular travel of the rotatable valve cylinder to rotation between the desired rotational extremes corresponding to the unsuppressed and suppressed operational modes of the gas block.

Embodiments of the rotatable valve cylinder may be integrally formed with or otherwise joined to an externally-accessible structural feature or component, which can be physically manipulated by an operator to place the MM gas block in a desired operational mode. This operator-manipulated feature or component is referred to herein as a "mode selector switch," with the term "switch" utilized to broadly refer to an operator-manipulated feature or element utilized to transition the gas block between different modes of operation. The mode selector switch may thus be a rotatable member, a translating member (e.g., a button), a toggle switch, or any other operator-manipulable feature or component, depending upon the particular manner in which the gas block and the valve element are implemented. In various embodiments, the mode selector switch is realized as a disc-shaped structure referred to herein as a "selector head," which is conveniently (although non-essentially) integrally formed with the rotatable valve cylinder as a single (e.g., machined) piece having a bolt-like formfactor. In this case, a raised protrusion, ridge, or paddle may be provided on the exterior of the selector head to allow an operator to turn the selector head, and therefore the rotatable valve cylinder, utilizing the operator's fingers. In other instances, the selector head may have a depression or groove formed in its outer surface to require the usage of a tool having a universal or a specialized security bit to turn the selector head. For example, in this latter regard, a slot may be formed in the outer face of the selector head in embodiments, with the slot sized and shaped to enable operator turning of the selector head utilizing the casing rim of a magazine cartridge compatible with the GPO firearm. In this manner, an operator can readily turn the selector head utilizing a nearby magazine cartridge (or a similar object having a flat edge of an appropriate size) to place the MM gas block in a selected mode, while inadvertent switching of the gas block between modes is avoided. In still other embodiments, the MM gas block may permit an operator to move the valve element between discrete positions in a different manner to place the gas block in a desired operational mode.

Embodiments of the MM gas block can include various other structural features in addition to or lieu of those mentioned above. For example, in certain embodiments, detent features may be incorporated into the MM gas block to deter movement of the valve element from a discrete position corresponding to an operator-selected mode of the gas block. As a specific example, and continuing the description above in which the MM gas block incorporates a valve element in the form of a rotatable valve cylinder integrally formed with (or otherwise fixedly joined to) an enlarged selector head, one or more spring-loaded detent features (e.g., spring-loaded pins or balls seating in grooves formed on an interior face of selector head) may act on the selector head or the rotatable valve cylinder itself. Such detent features generate a detent hold force when the rotatable valve cylinder is rotated into (i) a first position corresponding to the unsuppressed mode of the MM gas block, or (ii) a second position corresponding to the suppressed mode the gas block. Additionally or alternatively, the gas exhaust port may be formed as a cross-cut or other opening provided in a sidewall portion of the gas block body. The gas exhaust port may further be angled to discharge exhaust gas flow in a generally forward and lateral-outward direction when the gas block vents a fraction of the return gas flow in the suppressed mode of operation. In this manner, exhaust gas flow may be directed away from the operator, while producing minimal force acting on the GPO firearm in a lateral direction or vector.

Regardless of its particular construction, embodiments of the MM gas block provide controlled venting of excess gas flow when a GPO firearm is discharged in a suppressed state, while the gas block is switched into the suppressed mode of operation. This reduces peak internal pressures and gas flow rates within the MM gas block and the gas piston cylinder to maintain such parameters within optimal ranges despite the transient increases in backpressures within the firearm barrel occurring in conjunction with suppressor usage. Concurrently, venting of the return gas flow is sufficiently limited (e.g., via tailored dimensioning of a restricted flow orifice within the gas block) to ensure adequate gas flow is still supplied to the gas piston cylinder to drive gas piston retraction or rearward movement at a desired rate. Significant spikes in peak pressures occurring within MM gas block and the gas piston cylinder are consequently mitigated during suppressor usage to reduce component wear and stress, while bringing the rearward velocities of the gas piston, bolt carrier, and bolt into greater alignment with piston velocities observed when the GPO firearm is operated under standard, non-suppressed conditions. Any increase in the rearward force or recoil imparted to an operator through the GPO firearm is thereby minimized, if not wholly eliminated when operating the GPO firearm with a suppressor, with operator control of the GPO firearm and operator comfort enhanced as a result. As a still further benefit, a greater amount of gas-entrained particulate matter is expelled in conjunction with limited venting of the return gas flow when the MM gas block operates in the suppressed mode. This, in turn, minimizes contaminant build-up or fouling within the GPO firearm to better ensure reliable firearm operation and reduce the frequency with GPO firearm disassembly and cleaning is necessitated.

An example embodiment of the MM gas block, as installed on a GPO firearm, will now be discussed in conjunction with FIGS. 1-12. While described below in context of a particular type of GPO firearm, namely, a particular AK-47 variant, embodiments of the MM gas block can be utilized in conjunction with various other gas piston-operated firearms, which incorporate gas blocks to route return gas flow from the firearm barrel to a gas piston cylinder and thereby drive rearward movement of a gas piston in the manner previously described. By way of example, the below-described MM gas block is fabricated to possess certain design characteristics or structural features, such as a 90 degree flow architecture and a rotatable valve element. It will be appreciated, however, that alternative embodiments of the MM gas block can and will vary in formfactor, construction, and size, depending upon desired GPO firearm compatibility and other factors. For example, in further implementations, the MM gas block may be imparted with a non-90 degree flow architecture, such as a 45 degree flow architecture; and/or the gas block may contain a different type of valve element, such as a translating shuttle or spool, which can be manually positioned by a firearm operator to set the operational mode in which the MM gas block presently operates. The following description, then, should be understood as merely presenting non-limiting illustrations of example features and aspects of the present disclosure and should not be construed to unduly restrict the scope of the invention, as set-out in the appended Claims, in any respect.

Example Multi-Modal Gas Block and Gas Piston-Operated Firearm

Figure 2:
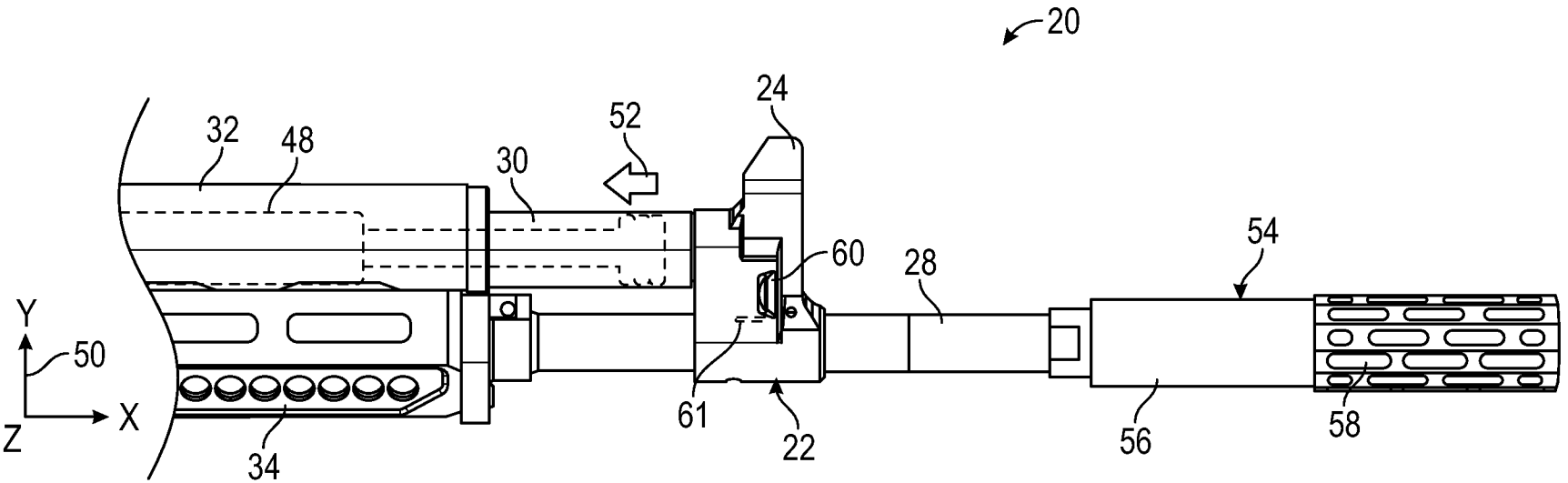
FIG. 2 is a second, opposing side view of the GPO firearm and multi-modal gas block shown in FIG. 1, further illustrating one manner in which the GPO firearm (partially shown) may be equipped with a suppressor.

Referring initially FIGS. 1 and 2, a GPO firearm 20 is equipped with a MM gas block 22, which may be installed in place of conventional gas block and which is illustrated in accordance with an example embodiment of the present disclosure. In the illustrated example, GPO firearm 20 assumes the form of a particular type or variant of an AK 47, while MM gas block 22 is imparted with a 90 degree flow configuration; that is, a configuration in which return gas flow is turned by approximately 90 degrees when traveling through MM gas block 22 from barrel 28 of GPO firearm 20 to a gas piston cylinder 30 further included in GPO firearm 20. In further embodiments, MM gas block 22 may be utilized in conjunction with another type of GPO firearm 20, such as a different AK47 type or various other firearms having gas piston-based designs and incorporating gas blocks. Additionally or alternatively, MM gas block 22 may be imparted with an alternative angular flow design, such as a 45 degree flow design, in further embodiments. Numerous other aspects or structural features of MM gas block 22 can also differ in alternative implementations, providing gas block 22 can be switched by a firearm operator between an unsuppressed (standard operation) mode and at least one suppressed (controlled venting) mode, as discussed throughout this document.

Generally progressing from left to right in FIG. 1, GPO firearm 20 includes a muzzle endpiece 26, an elongated barrel 28, a gas piston casing or cylinder 30, upper and lower handguards 32, 34, a rear sight block 36, and a main receiver body 38 (hereafter, a "receiver 38") from which the barrel 28 extends in a forward direction. A trigger 40 is positioned forward of a pistol grip 42, with a buttstock 44 further extending from receiver 38 in a rearward direction for abutment against an operator's shoulder when aiming and discharging firearm 20. A cartridge-carrying magazine, such as a curved, spring-loaded magazine 46, can be inserted into the lower well of receiver 38 as shown in FIG. 1 and interchanged with other magazines to continually provide firearm 20 with a supply of ammunition. When an operator discharges GPO firearm 20, rapidly-expanding combustive gasses are generated by ignition of gunpowder contained in the currently-chamber magazine cartridge. This gas flow propels the cartridge projectile from receiver 38 and through firearm barrel 28, with the projectile exiting GPO firearm 20 at a high velocity (e.g., a muzzle velocity exceeding 700 meters per second) via the distal end of barrel 28 and muzzle endpiece 26.

When GPO firearm 20 is discharged, a fraction of the rapidly-expanding gas flow is extracted from barrel 28, directed through MM gas block 22, and ultimately fed into gas piston cylinder 30 to enable the gas piston-based operation of GPO firearm 20. To allow extraction of gas flow from barrel 28, a relatively small orifice or opening (e.g., having a diameter ranging from about 0.5 to about 2 millimeters (mm)) is drilled or otherwise formed through a topside surface of barrel 28. As generically represented by a graphic 61 in FIG. 2, this orifice (herein, a "gas channel" or a "barrel bleed port") is formed at a location along the length of barrel 28 covered by MM gas block 22 when properly installed on GPO firearm 20. MM gas block 22 extracts return gas flow from firearm barrel 28 through barrel bleed port 61 in a generally upward direction, turns this gas flow approximately 90 degrees in a rearward direction, and then channels the return gas flow into gas piston cylinder 30. A gas piston 48, a leading portion of which is shown in phantom in FIG. 2, is slidably disposed within gas piston cylinder 30 and joined to a non-illustrated bolt carrier (positioned rearward of gas piston 48). When directed into gas piston cylinder 30, the rapidly-expanding gasses act on the exposed face of gas piston 48 to force the piston movement along a longitudinal axis of firearm 20 (corresponding to X-axis of coordinate legend 50) in a rearward direction, as indicated by arrow 52 (FIG. 2). This gas-driven motion of gas piston 48 further causes the bolt carrier, and a rotatable bolt moved by the bolt carrier, to slide rearward and eject the casing of the newly-spent cartridge from receiver 38. A non-illustrated carrier spring, typically positioned to the rear of the bolt carrier, compresses as gas piston 48 and the bolt carrier slide in a rearward direction. Gas piston 48, the bolt carrier, and the bolt then travel in a forward direction as the carrier spring expands, returning these components to their respective starting positions, while drawing a new magazine cartridge from magazine 46 into receiver 38 to ready GPO firearm 20 for the next projectile discharge cycle.

The above-described gas piston-based architecture enables GPO firearm 20 to rapidly progress through projectile discharge, casing ejection, and cartridge chambering actions in a highly reliable and repeatable manner. However, as is the case for many firearm platforms, GPO firearm 20 may generate relatively high noise levels during firearm discharge, which may be undesirable depending upon, for example, operator preferences or the circumstances under which firearm 20 is utilized. It is thus relatively common for firearm operators to outfit GPO firearms with noise-limiting muzzle devices, commonly referred to as "suppressors," to reduce noise levels generated during GPO firearm usage. An example of one such suppressor 54, as mounted to the distal end of barrel 28 in place of muzzle endpiece 26, is shown on the right of FIG. 2. When mounted to barrel 28 in the manner indicated, suppressor 54 functions to reduce noise levels by limiting the volume and velocity of gas flow escaping barrel 28 in conjunction with projectile discharge over a given period of time. Depending upon design specifics, suppressor 54 may accomplish this function by providing an additional volume of enclosed space in which combustive gasses can expand prior to exiting suppressor 54, while further posing an increased impedance to high velocity gas outflow from barrel 28 and suppressor 54. In the illustrated example, specifically, gas flow expansion may principally occur within a relatively large volume chamber located within a proximal portion 56 of suppressor 54, while a distal portion 58 of suppressor 54 contains internal features (e.g., various arrays of walls or baffles) increasing resistance to gas outflow through the distal opening of suppressor 54 to provide the desired noise suppression function. Numerous other suppressor designs are also possible and commercially available for usage in conjunction with GPO firearms.

While advantageous in reducing noise levels when GPO firearm 20 (or a similar GPO firearm) is discharged, the usage of suppressor 54 is associated with certain tradeoffs, some of which may negatively impact operator comfort and aspects of firearm performance. As a primary tradeoff, the attachment of suppressor, such as suppressor 54 shown in FIG. 2, elevates peak internal pressures and backflow rates of the return gas flow bled from barrel 28, routed through gas block 22, and directed into gas piston cylinder 30 for impingement against gas piston 48. This exacerbates mechanical stress and wear on the gas-exposed components of GPO firearm 20, while gas piston 48, the bolt carrier, and the bolt are driven in a rearward direction at an increased velocity during GPO firearm discharge. An operator of GPO firearm 20 may consequently experience a significant increase in the rearward impact force or recoil (kickback) imparted to the operator through pistol grip 42 and buttstock 44 when discharging firearm 20, which may detract from operator comfort and can potentially degrade an operator's targeting accuracy when discharging firearm 20 multiple instances in rapid succession. As a still further drawback, a greater volume of gas-entrained particulate matter, such as carbon and other combustive byproducts, may be captured within GPO firearm 20 when discharged in a suppressed state. Such particulate matter can accumulate over time and potentially detract from proper operation of GPO firearm 20 absent frequent disassembly and cleaning by a firearm operator. Some of these issues can be alleviated, to a limited extent, through the usage of a gas block incorporating a threaded member, which can be adjusted to create a greater or lesser impediment to return gas flow through a gas block by altering the degree to which the threaded member projects into a return gas flow path provided through the gas block. Such a solution, however, provides only moderate and imprecise reductions in the increased recoil (kickback) force occurring during suppressed operation of a GPO firearm, is relatively ineffective at addressing transient spikes in internal peak pressures and gas flow rates occurring within the gas block itself, and fails to curtail accelerated contaminant build-up occurring over time with suppressor usage.

As illustrated in FIGS. 1 and 2, GPO firearm 20 overcomes most, if not all of the limitations associated with suppressor usage through the incorporation MM gas block 22. MM gas block 22 provides such benefits, at least in part, by enabling manual switching of gas block 22 or, more generally, GPO firearm 20 between at least two discrete modes or operational settings: (i) an unsuppressed mode in which all or substantially all gas flow received into the inlet of gas block 22 from firearm barrel 28 is directed into gas piston cylinder 30 to drive the rearward movement of gas piston 48, and (ii) a suppressed mode in which a reduced fraction of gas flow is in injected into gas piston cylinder 30, while a second (e.g., lesser) fraction of the return gas flow is vented to the external environment through a gas exhaust port 60 formed in gas block 22 (visible in FIG. 2). A firearm operator can thus manually interact with MM gas block 22, when imparted with this multi-modal capability, to place gas block 22 in the appropriate mode for the current conditions under which GPO firearm 20 operates. Specifically, an operator may switch MM gas block 22 into the unsuppressed mode when GPO firearm 20 is utilized in an unsuppressed state (that is, without a suppressor) as shown in FIG. 1. In this instance, GPO firearm 20 will operate in an essentially typical or default manner, with optimal gas flow rates and pressures applied through MM gas block 22, through gas piston cylinder 30, and against the effective area of gas piston 48; noting, as described below, that embodiments of a valve element contained in MM gas block 22 may be structurally configured to provide minimal (essentially zero) additional flow resistance to return gas flow through gas block 22 when placed in the unsuppressed mode of operation. Conversely, when GPO firearm 20 is outfitted with a suppressor (e.g., suppressor 54, FIG. 2) and the firearm operator switches MM gas block 22 into the suppressed mode of operation, excess return gas flow is expelled via controlled venting through gas block 22.

Through controlled venting of the return gas flow when MM gas block 22 is switched into the suppressed mode of operation, transient spikes in internal gas pressures and flow rate, which would otherwise occur in conjunction with GPO firearm usage in a suppressed state, are significantly reduced, if not entirely mitigated. Component wear and stress is minimized as a result, while the rearward velocities of gas piston 48 (and the non-illustrated bolt carrier and bolt) are brought into greater alignment with piston velocities observed when GPO firearm 20 is operated under standard, non-suppressed conditions; e.g., in certain embodiments, MM gas block 22 may be configured (e.g., through dimensioning of a restricted orifice within gas block 22) to achieve gas piston retraction rates when GPO firearm 20 is operated in a suppressed state similar, if not substantially identical to those observed when firearm 20 is operated without suppressor 54. Consequently, the rearward force or recoil imparted to an operator through buttstock 44 and pistol grip 42 of GPO firearm 20 may be substantially consistent, or may increase only mildly, when operating GPO firearm 20 with a suppressor, providing MM gas block 22 is placed in the suppressed mode by the firearm operator when appropriate. As an additional benefit, gas-entrained particulate matter is expelled in conjunction with limited venting of the return gas flow through an exhaust port provided in the MM gas block 22; e.g., as described more fully below, a gas exhaust port 60 may be formed in a side portion of MM gas block 22 and angled to discharge gas flow in a generally forward and lateral-outward direction. This, in turn, minimizes contaminant build-up or fouling within GPO firearm 20 to better ensure reliable firearm operation and reduce the frequency with which GPO firearm cleaning is required.

MM gas block 22 enables operator switching between the suppressed and unsuppressed modes through manual movement or actuation of at least one valve element, which is contained or housed within gas block 22. In the illustrated example, MM gas block 22 contains a rotatable valve element or "rotatable valve cylinder," which can rotate about its centerline (e.g., parallel to the Z-axis of coordinate legend 50) between a first rotational position corresponding to the suppressed mode of MM gas block 22 and a second rotational position corresponding to the unsuppressed mode of gas block 22. An example of one manner in which MM gas block 22 may be designed and fabricated to contain such a rotatable valve element will now be described in connection with FIGS. 3-12. The following description notwithstanding, it is emphasized that MM gas block 22 represents but one possible implementation of the presently-disclosed multi-modal gas block, with a vast number of variations and alternative constructions possible. In further implementations, MM gas block 22 may be imparted with various other designs or constructions, providing that gas block 22 is operable in an unsuppressed mode and at least one suppressed mode enabling controlled venting of the return gas flow utilized to drive gas piston operation of a GPO firearm, as described throughout this document. In this regard, in alternative embodiments, MM gas block 22 may contain a sliding or translating valve element, such as a three way, spool-type valve, which can be manually positioned utilizing a turn-screw, a push button, or another manual interface. Additionally, embodiments of MM gas block 22 may contain a valve element manually movable between three or more discrete positions and configured to operate an equal number of modes or settings. For example, in certain instances, MM gas block 22 may be capable of operation in an unsuppressed mode, a first suppressed mode tuned for usage in conjunction with a first category of suppressors (e.g., suppressors inducing a moderate increase in peak gas backpressures within barrel 28), and a second suppressed mode tuned for usage in conjunction with a first category of suppressors (e.g., suppressors inducing a higher increase in barrel backpressures).

Figure 3:
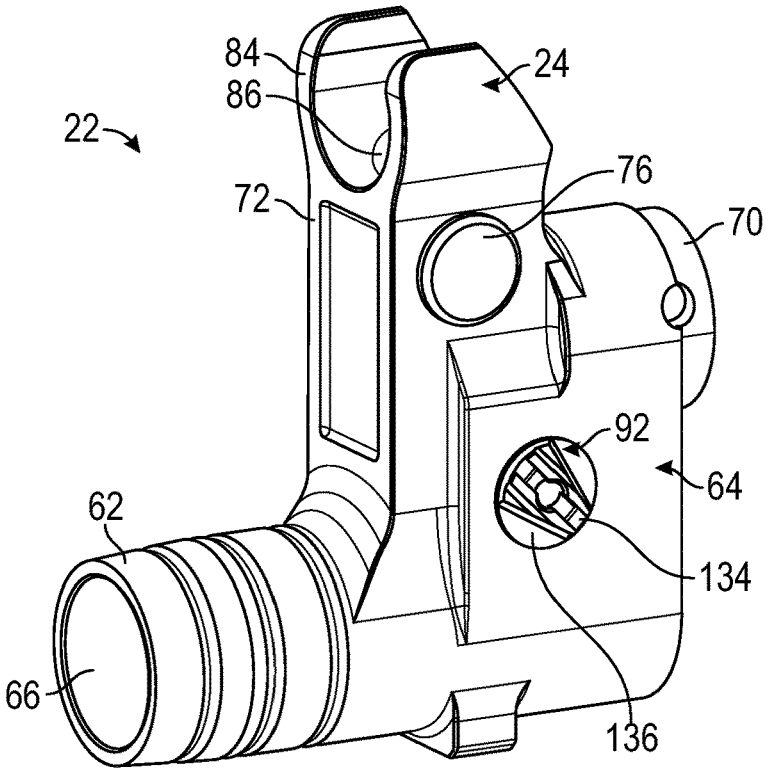
FIGS. 3 and 4 are opposing side isometric views of the example multi-modal gas block shown in FIGS. 1 and 2 illustrating the gas block in greater detail.
Figure 4:
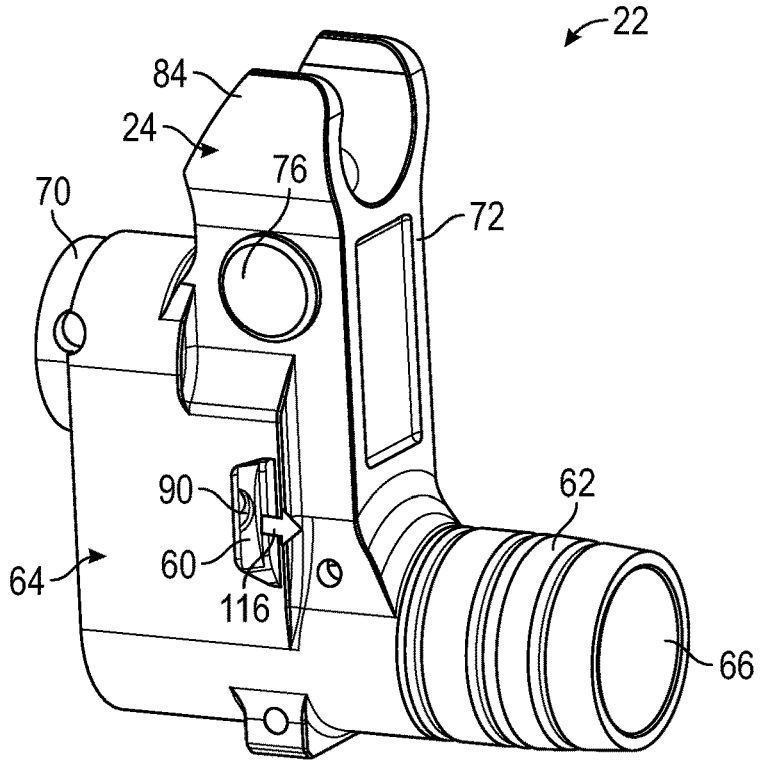
Figure 5:
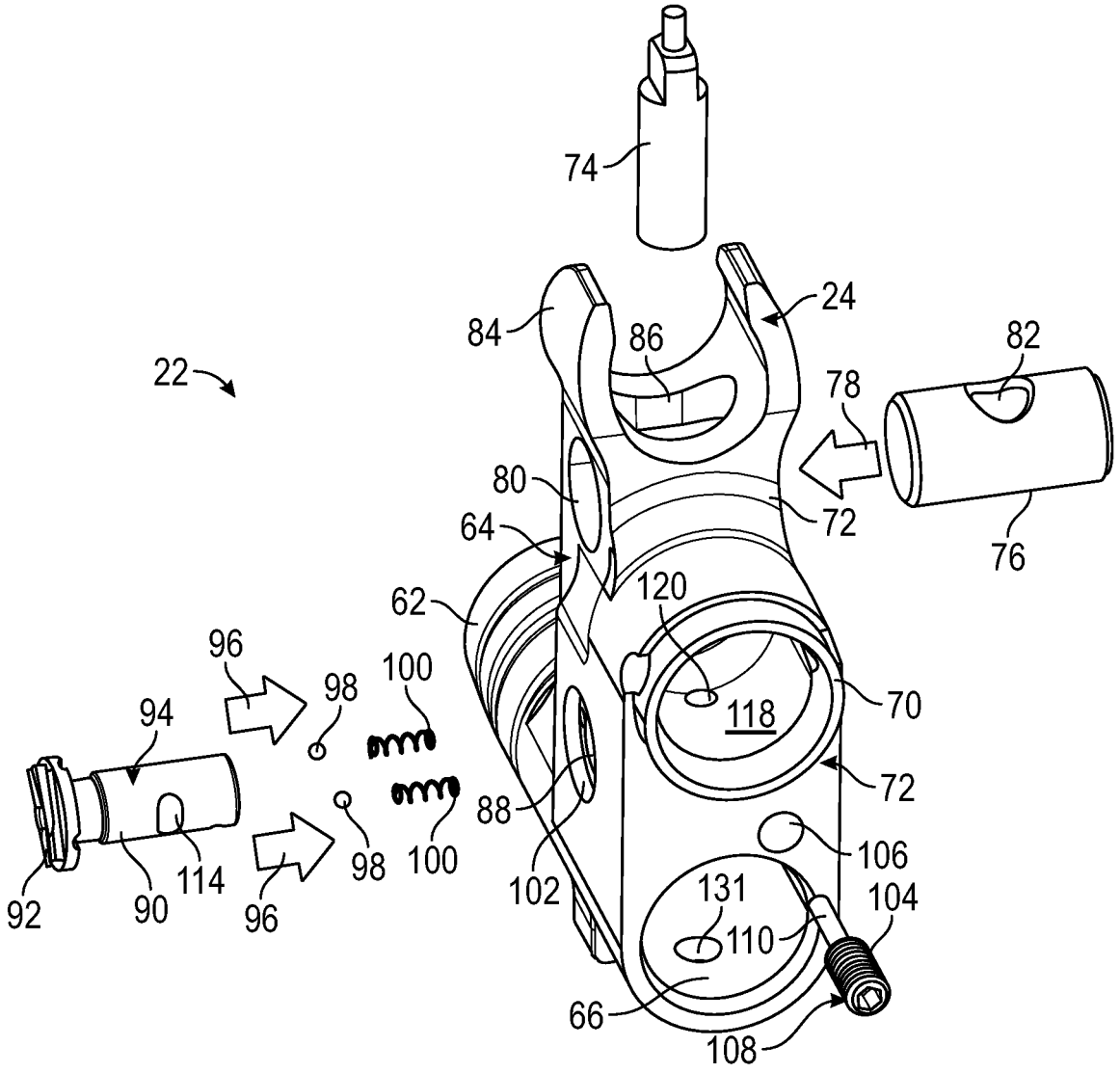
FIG. 5 is a rear exploded view of the multi-modal gas block shown in FIGS. 1-4 revealing, among other structural features, a valve element in the form of a rotatable valve cylinder and a threaded retention pin, which captures the rotatable valve cylinder within the gas block when assembled.

Turning now to FIGS. 3-5, example MM gas block 22 is shown in greater detail. MM gas block 22 includes a lower barrel mount 62 and an upper gas block body 64, which are conveniently, although non-essentially fabricated as a single piece in embodiments. Lower barrel mount 62 can include any number of components and structural features suitable for removably securing MM gas block 22 to GPO firearm 20, while placing a gas inlet port of gas block 22 (described below) in fluid communication with barrel bleed port 61 (FIG. 2) when gas block 22 is properly installed on firearm 20. In the illustrated embodiment, lower barrel mount 62 assumes the form of a generally tubular structure, which can be positioned in a close-fit relationship around barrel 28 or, perhaps, joined to different segments of barrel 28 forming multiple gas-tight joints. A longitudinal bore or cylindrical channel 66 extends axially or longitudinally through lower barrel mount 62 to receive a segment of barrel 28 in a mating relationship, as shown in FIGS. 1 and 2. Similarly, in the example embodiment, upper gas block body 64 is fabricated to include a tubular collar 70, which extends from gas block body 64 in a rearward direction for insertion into a leading portion of gas piston cylinder 30. Such a mounting interface securely affixes MM gas block 22 to GPO firearm 20 in the desired position, while providing a gas-tight fit along interfaces formed between gas block 22, barrel 28, and gas piston cylinder 30. In other embodiments, a different gas block mounting scheme may be employed, providing the gas inlet port of MM gas block 22 is adequately secured to GPO firearm 20, while the gas inlet port of gas block 22 is placed in fluid communication with barrel bleed port 61.

As previously noted, lower barrel mount 62 and upper gas block body 64 may be fabricated as a single structure or unitary piece in embodiment by, for example, machining a metallic blank or preform to define the various ports, cavities, flow channels, and other features of gas block body 64. In other implementations, lower barrel mount 62 and an upper gas block body 64 can be produced from multiple discrete pieces, which are assembled and joined in a non-permanent manner (e.g., utilizing fasteners) or permanent manner (e.g., via welding). Further, as discussed below, MM gas block 22 may be fabricated to include a front sight assembly 24 for visual reference in operator aiming of GPO firearm 20. When furnished with such a front sight assembly 24, MM gas block 22 may further contain a front sight block 72 (e.g., integrally formed with lower barrel mount 62 and upper gas block body 64), a front sight post 74 (FIG. 5), and a sight post adjustment base or pin 76. As indicated by arrow 78 in FIG. 5, sight post adjustment pin 76 may be installed in a cross-bore 80 extending laterally through front sight post 74. A lower portion of front sight post 74 is received within an opening provided in sight post adjustment pin 76, as well as within a vertical bore 86 formed in front sight block 72 (shown most clearly in FIGS. 6 and 7). Such a mounting scheme allows an upper portion of front sight post 74 to remain visible between a pair of upper arcuate arms 84 included in front sight block 72, while front sight post 74 can rotate or swivel within certain limits about its centerline, which is parallel to a lateral axis of GPO firearm 20 (corresponding to the Z-axis of coordinate legend in FIG. 2). In further implementations, MM gas block 22 may incorporate a front sight assembly having a different construction or any such front sight assembly may be omitted from gas block 22.

As identified in FIG. 5, a valve element cavity 88 is formed in MM gas block 22 and structurally configure (sized and shaped) to receive a movable valve element therein. Valve element cavity 88 has a generally cylindrical shape in the illustrated example and extends into gas block body 64 from a sidewall thereof, which is laterally opposite the sidewall of body 64 in which gas exhaust port 60 is formed. In the illustrated example, the valve element assumes the form of a rotatable valve cylinder 90, which can be turned by a firearm operator through interaction with a manual interface or mode selector switch; here, provided in the form of an enlarged, disc-shaped selector head 92. As indicated in FIG. 5, selector head 92 may be integrally formed with rotatable valve cylinder 90 as a unitary or single piece 94 (referred to below as a "valve-head piece 94") having a bolt-like formfactor, although this may vary in other embodiments. Arrows 96 indicate the manner in which rotatable valve cylinder 90 may be inserted into valve element cavity 88 from a side of MM gas block 22, as taken along a lateral axis of GPO firearm 20 substantially parallel to Z-axis of coordinate legend 50 (FIG. 2). When rotatable valve cylinder 90 is fully inserted into valve element cavity 88, selector head 92 seats within an outer cylindrical step or annular shelf 102, which has an increased outer diameter relative to cavity 88 and thus forms a step-like shelf located adjacent an inner face of selector head 92. So too are one or more detent features 98, 100 received within corresponding cavities formed in gas block body 64; e.g., detent features 98, 100 (and particularly springs 100) may be received within relatively narrow bores or channels, which extend from annular shelf 102 into gas block body 64 toward the opposing sidewall of body 64 along axes substantially parallel to the centerline of cavity 88.

Depending upon implementation, detent features 98, 100 may physically engage either selector head 92 or valve cylinder 90 to provide the desired detent functions. For example, in the present embodiment, detent features 98, 100 engage the inner face of selector head 92 (that is, the principal surface of selector head 92 facing annular shelf 102) to generate a detent hold force, which assists in maintaining the current angular position of rotatable valve cylinder 90 when moved into a designated position corresponding to a selected operative mode of MM gas block 22. Such a detent effect also provides a tactile cue to the operator indicating when valve-head piece 94, and therefore rotatable valve cylinder 90, has been fully rotated into a desired position. Specifically, detent features 98, 100 include ball bearings 98 contacted by compression springs 100, which urges ball bearings 98 into certain depressions or cutout features formed on the inner face of selector head 92, as discussed below in connection with FIGS. 11 and 12. In further embodiments, a different type of detent feature (e.g., spring-loaded plungers) may be incorporated into MM gas block 22 or gas block 22 may lack any such detent features. Regardless of whether detent features are incorporated into a particular embodiment of MM gas block 22, markings or visually-distinguishable reference features are conveniently provided on the exterior face of selector head 92 and the neighboring surface of gas block body 64 to visually indicate the current rotational orientation of rotatable valve cylinder 90 relative to the first and second positions corresponding to the unsuppressed and suppressed modes of operation, respectively.

MM gas block 22 further includes at least one retention member for physically capturing or confining rotatable valve cylinder 90 within valve element cavity 88, while permitting rotation of valve cylinder 90 relative to gas block body 64 between the first and second positions. In the illustrated example, a threaded retention pin 104 is utilized to retain valve cylinder 90 within gas block body 64 and, further, to provide hard stop functioning limiting the angular travel of rotatable valve cylinder 90 beyond first and second rotational extremes. As indicated in FIG. 5, threaded retention pin 104 is received within an elongated pin cavity 106, which may be formed in a leading or front surface of gas block body 64. A threaded portion 108 of retention pin 104 engages an internally-threaded region of cavity 106 to secure retention pin 104 within gas block body 64, while a non-threaded shaft portion 110 engages into an accurate or peripheral groove 112 formed about an outer periphery of rotatable valve cylinder 90 (shown in FIGS. 8-12, described below). Other features may also be formed in rotatable valve cylinder 90, such as a contoured notch 114 formed in a peripheral portion of rotatable valve cylinder 90. Contoured notch 114 rotates into alignment with the primary gas return path when valve cylinder 90 is rotated into the first position and may be imparted with a contoured or streamlined geometry complementary to the gas return path to minimize protrusion of rotatable valve cylinder 90 into a primary gas return path of MM gas block 22, as discussed below in connection with FIG. 6. Gas exhaust port 60 is fluidly coupled to valve element cavity 88 to permit controlled venting of the return gas flow when rotatable valve cylinder 90 is moved into a position corresponding to the suppressed mode of MM gas block 22. Gas exhaust port 60 may be formed in a sidewall portion of gas block body 64 (e.g., opposite the side of gas block body 64 at which selector head 92 is accessible) and angled to direct gas flow in laterally-outward and forward directions, as indicated in FIG. 4 by arrow 116. Exhaust gas flow is thus directed away from the firearm operator when vented through exhaust gas port 60, which may be defined utilizing a cross-cut technique or another material removal technique in embodiments.

Figure 6:
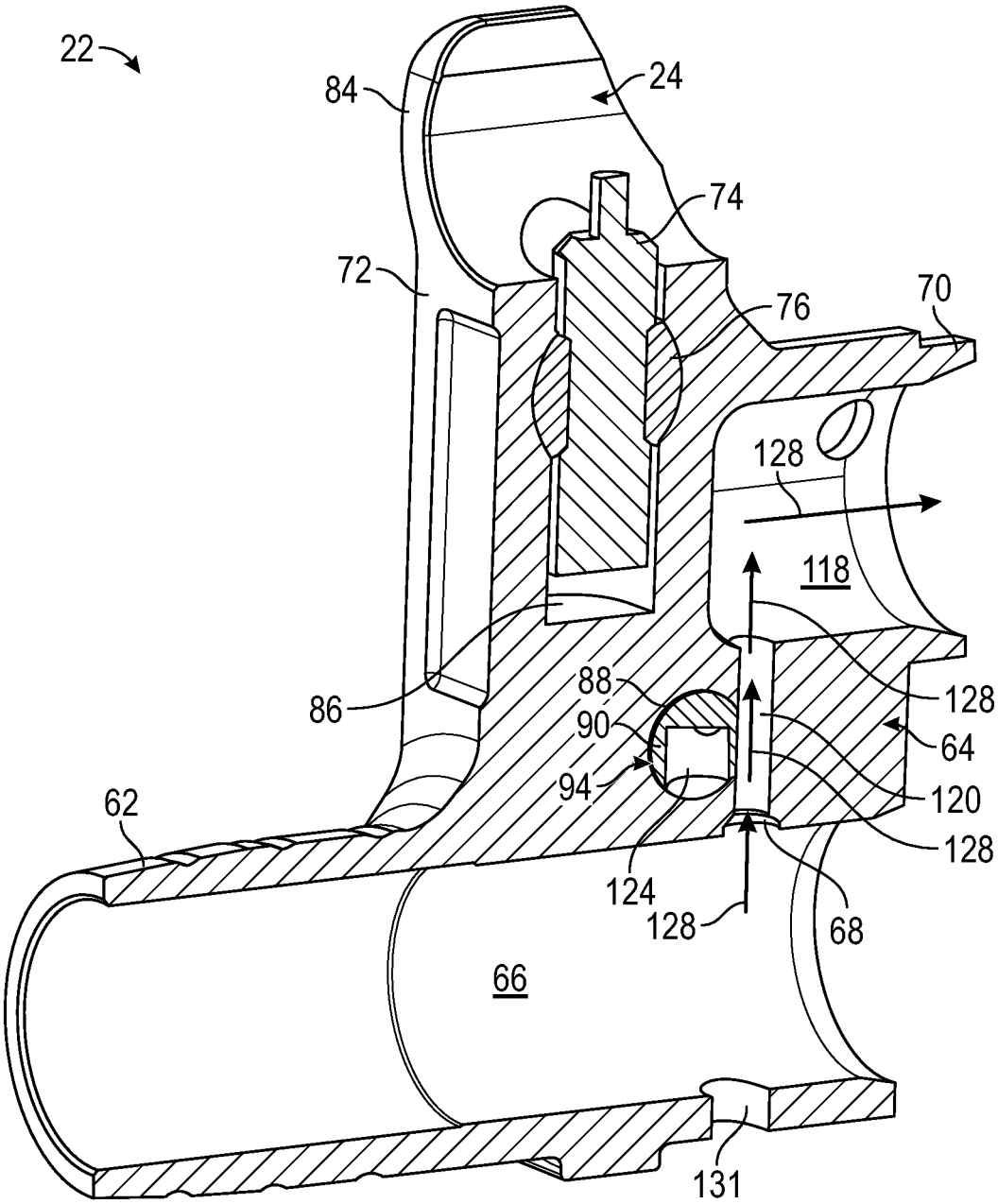
FIGS. 6 and 7 are cross-sectional isometric views of the multi-modal gas block shown in FIGS. 1-5 taken along a first axially- or longitudinally-extending section plane and depicted in unsuppressed and suppressed modes, respectively.
Figure 7:
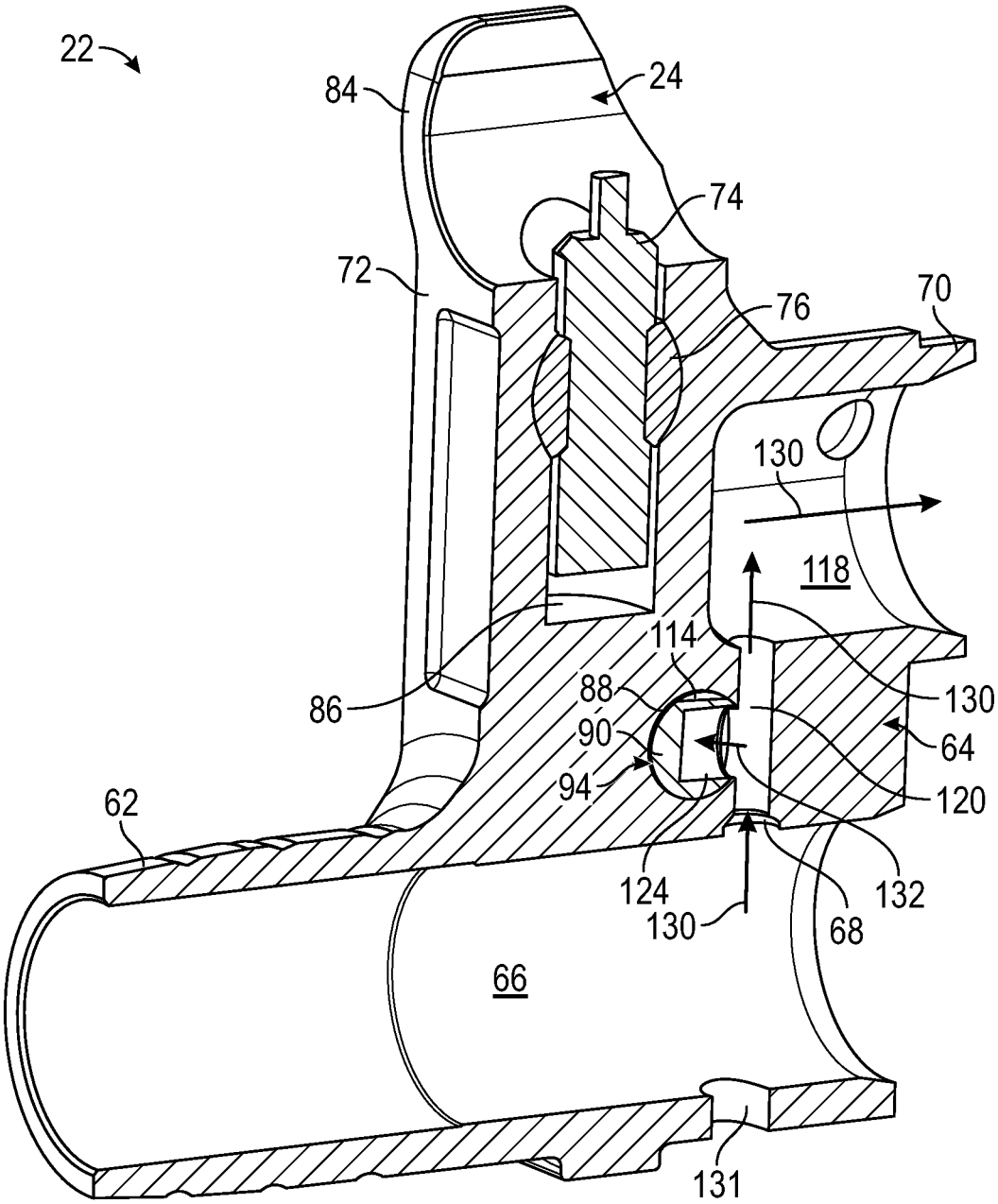
Figure 8:
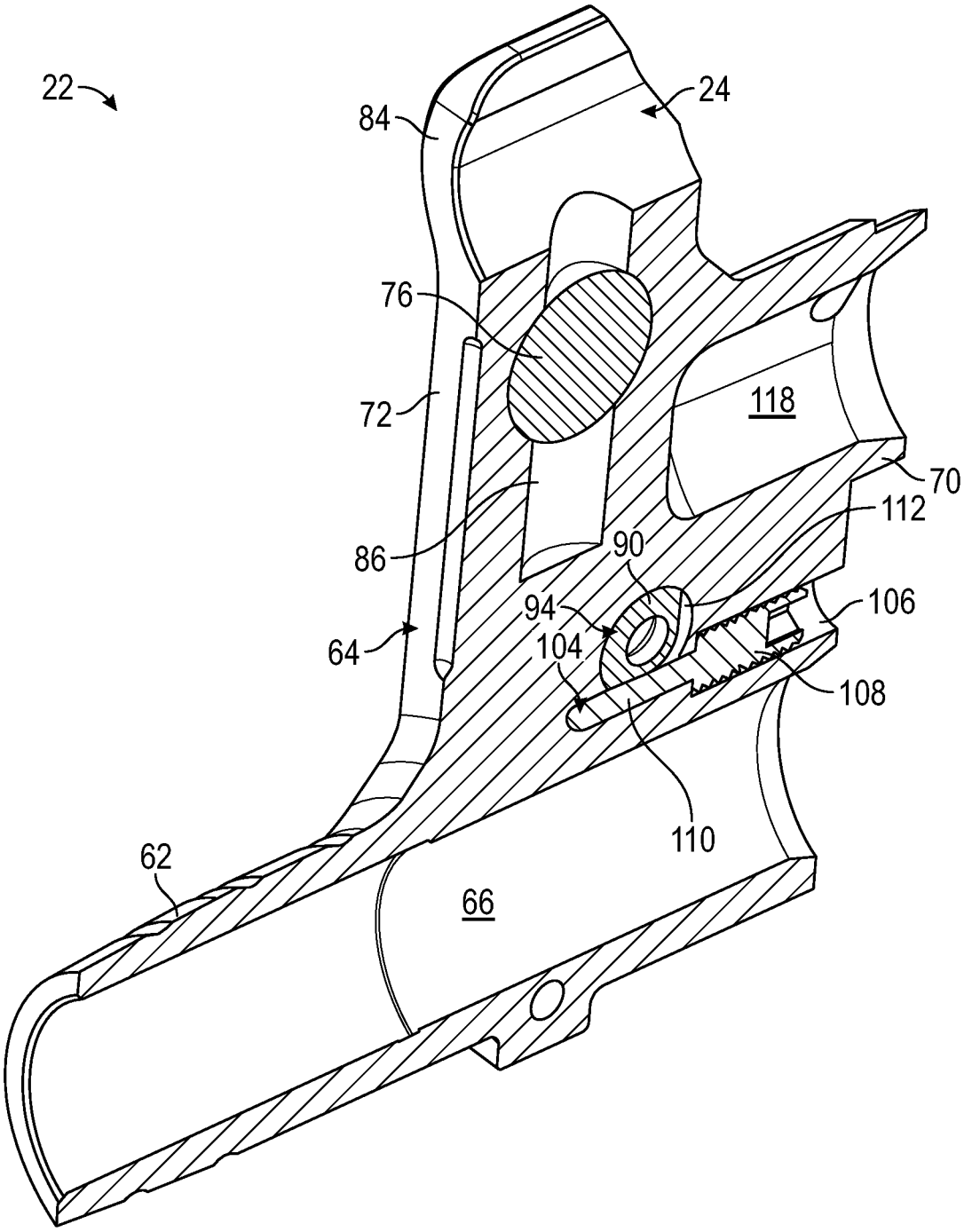
FIG. 8 is a cross-sectional isometric view of the example multi-modal gas block shown in FIGS. 1-7, taken along a second longitudinally-extending section plane transecting the rotatable valve cylinder and the threaded retention pin.
Figure 9:
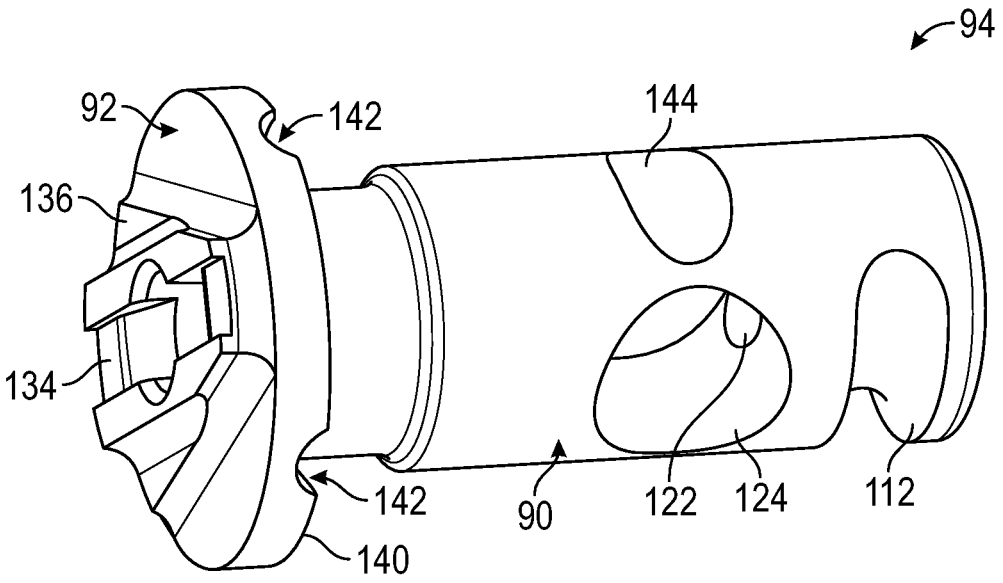
FIGS. 9 and 10 are isometric and cross-sectional isometric views, respectively, of a rotatable valve cylinder and a selector head, which may be integrally formed as a single piece in embodiments and which are suitably contained in the multi-modal gas block shown in FIGS. 1-8.
Figure 10:
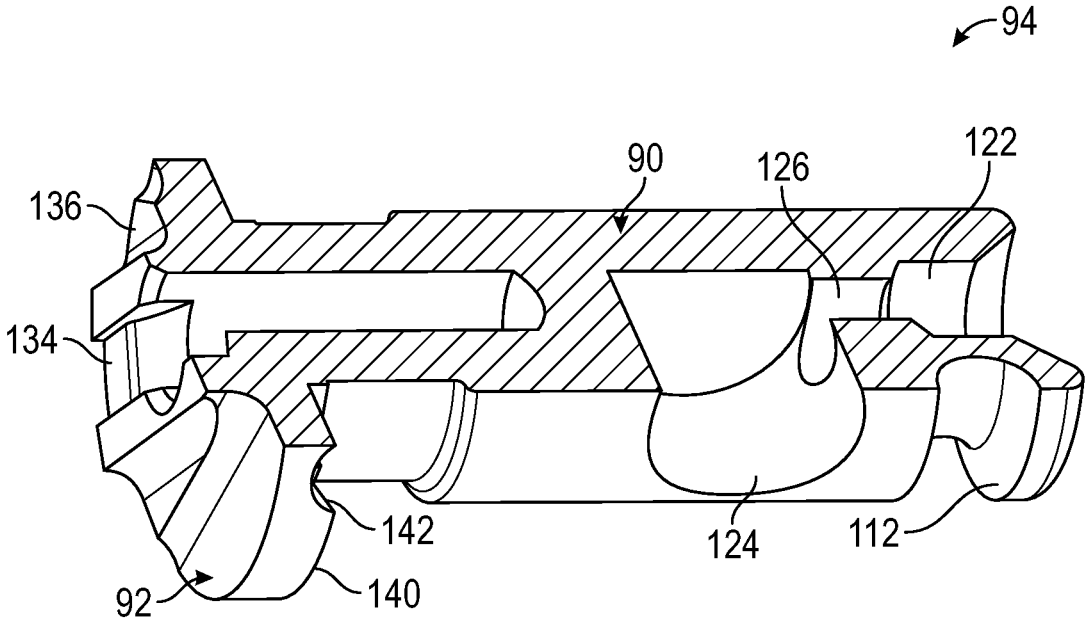

Referring now to FIGS. 6 and 7 in conjunction with FIGS. 3-5, a gas return outlet or port 118 is further formed in gas block body 64. Gas return port 118 is fluidly coupled to a gas inlet port 68 of MM gas block 22 via a primary gas return path 120; that is, the flow path along which return gas flow is principally or exclusively directed when routed from a firearm barrel (e.g., barrel 28) to a gas piston cylinder (e.g., gas piston cylinder 30) of a GPO firearm. Gas return port 118 is placed in fluid communication with an inlet of gas piston cylinder 30 when cylinder 30 is matingly fit onto rearwardly-projecting collar 70 of gas block body 64, as shown in FIGS. 1 and 2. As previously indicated, primary gas return path 120 fluidly couples gas return port 118 (positioned above barrel bleed port 61 when gas block 22 is installed on GPO firearm 20) to gas return port 118. Primary gas return path 120 can be formed from any number of individual conduits or intersecting flow channels in embodiments. In the illustrated example, primary gas return path 120 is defined by a single flow channel, which extends in a height-wise direction (corresponding to the Y-axis of coordinate legend 5) along a substantially linear path to intersect an outer peripheral portion of valve element cavity 88; e.g., as indicated, primary gas return path 120 may extend principally along an axis substantially perpendicular to the axes (centerlines) along which valve element cavity 88 and valve element 90 extend. Such a configuration generally allows efficient, low loss gas flow from gas inlet port 68 to gas return port 118 through primary gas return path 120. Additionally, such a configuration facilitates manufacture of MM gas block 22 by allowing primary gas return path 120 to be drilled (e.g., utilizing a drill press) or otherwise cut into gas block body 64 through a bottom wall of lower barrel mount 62, as indicated by the concurrently-formed access opening 131 identified in FIGS. 5-7.

At least one flow passage or channel is formed in rotatable valve cylinder 90 to allow return gas flow through cylinder 90 when rotated into a position corresponding to the suppressed mode of MM gas block 22. In the illustrated example, and appreciated most readily by reference to FIGS. 9 and 10, rotatable valve cylinder 90 may include an axial flow channel 122 extending along a centerline of valve cylinder 90, as well as a radial flow channel 124 intersecting axial flow channel 122 at a predetermined angle. As shown most clearly in FIG. 10, a restricted flow passage section or orifice 126 is formed in axial flow channel 122 and may be carefully sized to achieve the desired the flow rate through rotatable valve cylinder 90 during firearm discharge when valve cylinder 90 is turned to the rotational position corresponding to the suppressed mode of MM gas block 22. Radial flow channel 124 may be oriented or positioned such that gas flow travels from radial flow channel 124 into axial flow channel 122 before exiting rotatable valve cylinder 90 when rotated into the second position. Radial flow channel 124 and axial flow channel 122 are formed to intersect at a predetermined angle (e.g., approximately a 90 degree angle) in the illustrated example, with axial flow channel 122 extending substantially parallel to and coaxial with the centerline of rotatable valve cylinder 90 and, more generally, valve-head piece 94. In further implementations, rotatable valve cylinder 90 may have a different flow passage configuration, which can include, for example, one or more flow channels formed as grooves or trenches extending along the exterior of valve cylinder 90 and cooperating with the inner walls defining valve element cavity 88 (or a sleeve inserted into cavity 88) to direct the return gas flow in the desired manner, depending upon the rotational positioning of valve cylinder 90.

As indicated above, a restricted orifice 126 (FIG. 10) is formed within rotatable valve cylinder 90 in the illustrated example. Restricted orifice 126 may be formed as a constricted flow passage section (here, having a generally cylindrical geometry) and may be dimensioned to limit a peak gas flow rate from gas inlet port 68 to gas exhaust port 60 in a desired manner; e.g., in embodiments, the diameter of restricted orifice 126 may be selected to limit a peak gas flow rate from gas inlet port 68 to gas exhaust port 60 to less than the peak gas flow rate from the gas inlet port to gas return port 118 when rotatable valve cylinder 90 resides in the second position and GPO firearm 20 is discharged. In this regard, in at least some realizations, restricted orifice 126 may have a minimum diameter (or other minimum cross-sectional dimension) less than the respective minimum diameters of primary flow return path 120 and radial flow channel 124. Optimal dimensioning of restricted orifice 126 for a given GPO firearm and suppressor category or type can be determined through iterative physical testing in embodiments. For example, in once approach, restricted orifice 126 may be imparted with a relatively small diameter during an initial testing run and then gradually enlarged in a step-wise manner per testing iteration until arriving at optimally-sized orifice. Thus, in this approach, increasing amounts of material may be removed from the inner annular wall defining orifice 126 to gradually enlarge orifice 126 utilizing a suitable cutting tool, such as a drill press outfitted with different bits to vary the diameter of orifice 126. Such a cutting tool may be carefully inserted through open end of cylinder 90 opposite selector head 92 to remove material from the interior walls defining orifice 126 until orifice 126 is brought to its desired final dimension.

In the above-described manner, orifice 126 can be dimensioned in a highly precise manner to ensure that a sufficient volume of gas flow is vented through MM gas block 22 when in the suppressed mode to maintain internal flow rates and pressures within optimal ranges, while concurrently ensuring that excess venting does not occur and adequate pressurization of gas piston cylinder 30 is achieved to allow relatively rapid and complete retraction of gas piston 48 when GPO firearm 20 is discharged. In other embodiments, a different technique may be employed (e.g., computational flow analysis) to determine the appropriate dimensions for restricted orifice 126 for a given GPO firearm and suppressor type. Further, in other embodiments, the restricted orifice may be formed in gas block body 64 itself; e.g., at a location immediately upstream of gas exhaust port 60. This stated, restricted orifice 126 is advantageously located in rotatable valve cylinder 90 in embodiments as such a positioning enables gas block body 64 to have a universal or partially-universal design suitable for usage with multiple different suppressor types, with fine tuning of MM gas block 22 then accomplished through the provision of a rotatable valve cylinder having a restricted orifice appropriately sized for a particular type or category of suppressor. In this regard, multiple valve-head pieces 94 having different orifice sizes may be fabricated, with each valve-head piece 94 otherwise shaped and sized for universal compatibility or interchangeability with gas block body 64. A valve-head piece 94 having an appropriately-sized orifice may then be selected by an equipment supplier or the firearm operator depending upon the characteristics of the suppressor ultimately utilized in conjunction with GPO firearm 20. This provides a high level of modularity enabling MM gas block 22 to be customized for usage in conjunction with a wide range of suppressor types.

With continued reference to FIGS. 3-10, and as shown most clearly in FIGS. 6 and 7, radial flow channel 124 closes to primary gas return path 120 when valve cylinder 90 is rotated by an operator into the first position corresponding to the unsuppressed mode of MM gas block 22. Conversely, and as noted above, radial flow channel 124 opens to primary gas return path 120 when rotatable valve cylinder 90 is rotated into the second position corresponding to the suppressed mode of gas block 22. Thus, when rotatable valve cylinder 90 is rotated into the second position placing MM gas block 22 in the unsuppressed mode of operation, all or substantially all gas flow bled from firearm barrel 28 via gas inlet port 68 is directed through gas block 22 and into gas piston cylinder 30, as indicated in FIG. 6 by flow arrows 128. Further, as can be seen in this drawing figure, rotation of valve cylinder 90 into the first position brings contoured notch 114 into alignment with the flow passage walls defining primary gas return path 120; noting that contoured notch 114 is generally formed adjacent radial flow channel 124, but angularly offset or spaced therefrom as taken about the outer periphery of valve cylinder 90 such that, as contoured notch 114 rotates into alignment with primary gas return path 120, radial flow channel 124 concurrently closes to gas return path 120. As valve cylinder 90 is rotated into the first position, an aerodynamically-streamlined, smooth, or essentially stepless transition is provided at the interface of valve cylinder 90 and primary gas return path 120, with protrusion of rotatable valve cylinder 90 into primary gas return path 120 minimized due to the provision of notch 114. Consequently, when switched in the unsuppressed mode by an operator in conjunction with unsuppressed operation of GPO firearm 20, MM gas block 22 supports firearm operation in a manner similar to or substantially identical to gas flow routing through a conventional, non-vented gas block to provide consistent performance familiar to firearm operators.

MM gas block 22 is switched into the suppressed mode of operation when rotatable valve cylinder 90 is rotated into its second position by a firearm operator. Further, as rotatable valve cylinder 90 is rotated, radial flow channel 124 is turned to open toward primary gas return path 120 to establish fluid communication between gas return path 120 and gas exhaust port 60 through the body of valve cylinder 90. Accordingly, when GPO firearm 20 is discharged with MM gas block 22 placed in its suppressed mode of operation, a controlled fraction of the gas flow conducted through primary gas return path 120 from gas inlet port 68 to gas return port 118 (represented in FIG. 7 by arrows 130) is diverted into radial flow channel 124 of rotatable valve cylinder 90, as indicated in FIG. 7 by arrow 132. The diverted gas flow is conducted through radial flow channel 124 and into axial flow channel 122 before exiting an end portion of valve cylinder 90 opposite selector head 92. The diverted gas flow is then discharged from MM gas block 22 via gas exhaust port 60, as discussed above and indicated by arrow 116 in FIG. 4. The vented fraction of the gas flow is advantageously controlled, through tailoring of restricted orifice 126 within axial flow channel 122 of rotatable valve cylinder 90, to at least partially, if not substantially entirely offset any elevations in gas flow rates and peak internal pressures otherwise occurring if GPO firearm 20 were to be utilized in a suppressed state in conjunction with a conventional, non-vented gas block. By providing controlled venting of the return gas flow when placed in a suppressed mode in this manner, MM gas block 22 alleviates suppressor-induced increases in peak pressures and gas flow rates, thereby reducing component wear and minimizing any increase in the rearward forces imparted to the firearm operator. Advantageously, MM gas block 22 may be tuned to provide controlled venting of an appropriate fraction of the return gas flow to substantially offset the increase in backpressure within barrel 28 associated with usage of a particular suppressor 54.

In the above-described manner, rotatable valve cylinder 90 cooperates with gas block body 64 to effectively form a three way, two position valve, which is highly compact, produced with a minimal part count, and structurally robust to ensure prolonged reliability over time and within relatively harsh operational environments. Further, as described throughout this document, rotatably valve cylinder 90 is readily manually-actuated or manipulated by a firearm operator through operator-controlled positioning of the valve element (here, rotatable valve cylinder 90). In the illustrated example, the angular or rotational position of rotatable valve cylinder 90 is manually adjusted by an operator through physical interaction with enlarged selector head 92 of valve-head piece 94. To facilitate operator interaction, a raised protrusion or ridge may be provided on the exterior of selector head 92 to allow an operator to turn selector head 92, and therefore the rotatable valve cylinder, utilizing the operator's fingers. In other instances, selector head 92 may have a depression or groove formed therein to generally require the usage of a tool or implement to turn selector head 92 and rotatable valve cylinder 90. For example, in this latter regard and as shown most clearly in FIG. 3, a slot 134 may be formed in an outer face 136 of the selector head, with the slot sized and shaped to enable operator turning of selector head 92 utilizing a casing rim of a round compatible with GPO firearm 20. In this manner, an operator can readily turn selector head 92 utilizing a nearby magazine cartridge (or a similar object having a flat edge of an appropriate size) to place MM gas block 22 in a selected mode, while the likelihood of inadvertent switching of MM gas block 22 between modes of operation is reduced, if not eliminated. In other embodiments, selector head 92 may have physical features allowing turning of valve-head piece 94 utilizing a common driver bit, a security bit, a hex key, or a similar tool.

Figure 11:
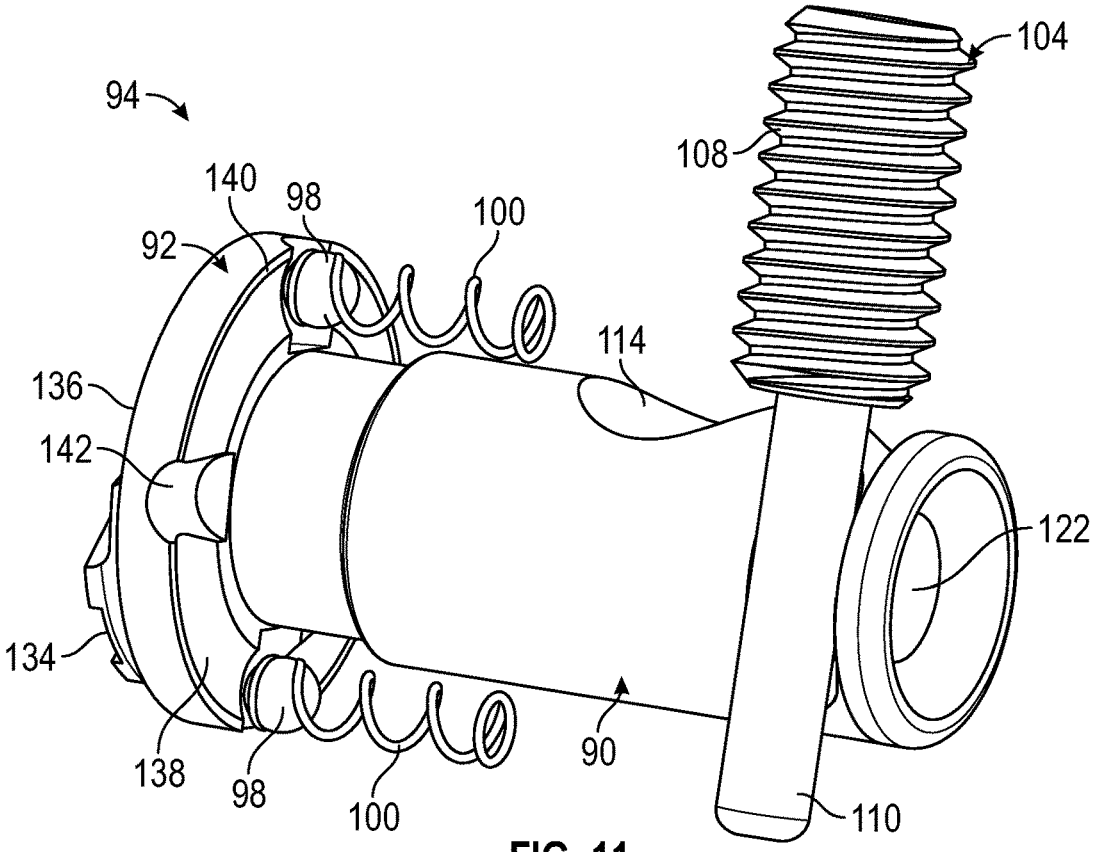
FIGS. 11 and 12 are isometric views of the rotatable valve cylinder, the selector head, the threaded retention pin, and spring-loaded detent features contained in the example multi-modal gas block and illustrating the positioning of these components when the gas block is switched into the unsuppressed and suppressed modes of operation, respectively.
Figure 12:
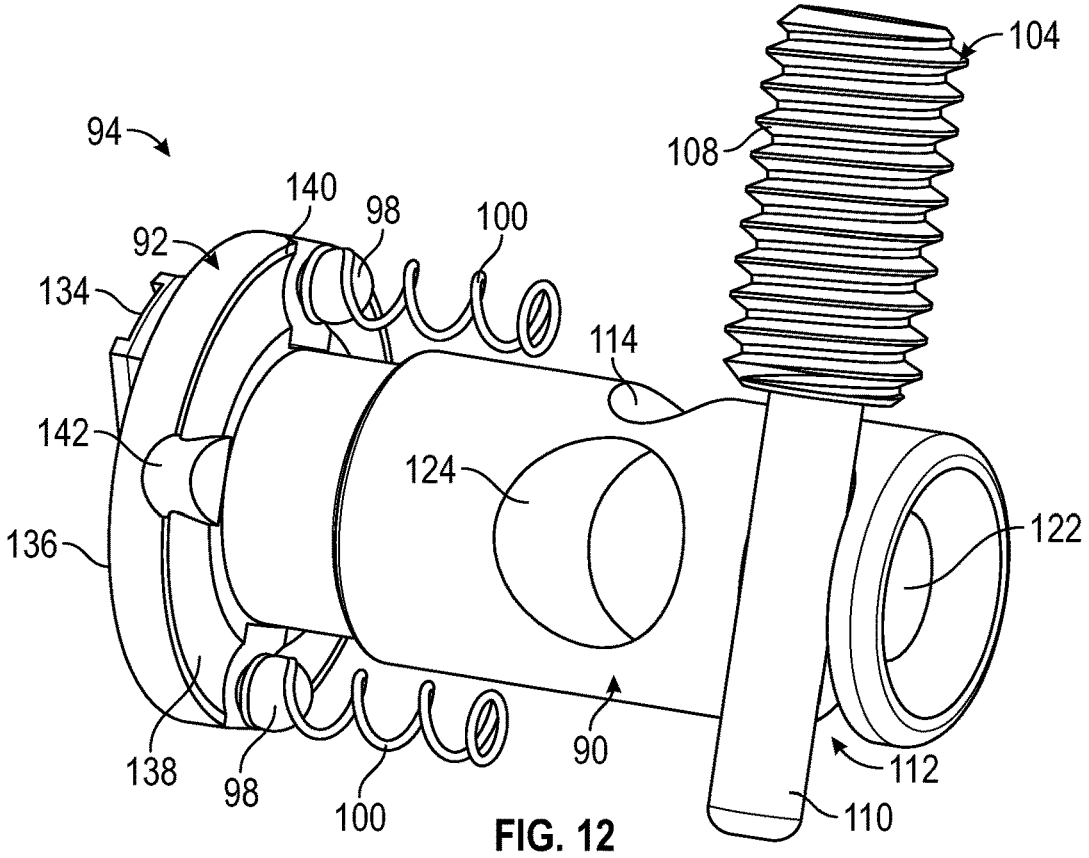

Progressing lastly to FIGS. 11 and 12, rotatable valve cylinder 90, threaded retention pin 104, and detent features 98, 100 are shown in isolation. A relatively shallow, annular trench or groove 138 is formed in an outer peripheral portion of the backside or inner face 140 of selector head 92. Four slots or depressions 142 (e.g., notch-shaped cutouts) are further formed in inner face 140 and angularly spaced by 90 degree intervals. Depressions 142 are distributed around inner face 140 of selector head 92, with different segments of annular groove 138 extending between and connecting depressions 142. Groove 138 and depressions 142 cooperate with detent features 98, 100, which are further contained in MM gas block 22, to provide a detent hold force helping maintain rotatable valve cylinder 90 in the first position and the second position. As shown, detent features 98, 100 may include ball bearings 98, which contact (e.g., seat on) the outer ends of wireform compression springs 100. The expansive force of compression springs 100 urges ball bearings 98 again the inner face 140 of selector head 92, with ball bearings 98 riding in annular groove 138 when selector head 92 and rotatable valve cylinder 90 are turned by a firearm operator. Ball bearings 98 further rotate into alignment with depressions 142 formed on inner face 140 when selector head 92 and rotatable valve cylinder 90 are rotated into the first position (corresponding to the unsuppressed mode of gas block 22) or into the second position (corresponding to the suppressed mode of gas block 22). When so aligned, ball bearings 98 are pressed into depressions 142 by springs 100 to lightly lock selector head 92 and rotatable valve cylinder 90 into either the first position or the second position, as the case may be, until the firearm operator exerts a sufficient turning force or torque on selector head 92 to again compress springs 100 and unseat ball bearings 98 for travel along groove 138. In this manner, detent features 98, 100 impede rotation of selector head 92 and rotatable valve cylinder 90 from either the first position and from the second position to reduce the likelihood of inadvertent displacement of valve cylinder 90 from a current operator-selected position; and to further ensure that an operator fully turns selector head 92 and rotatable valve cylinder 90 into a rotational position corresponding to the selected mode.

When rotatable valve cylinder 90 and selector head 92 are manually turned by an operator of GPO firearm 20 in the manner just described, non-threaded shaft portion 110 of retention pin 104 slides or travels within peripheral groove 112 to accommodate manual turning of rotatable valve cylinder 90, while preventing withdrawal of rotatable valve cylinder 90 from valve element cavity 88 in an axial or a laterally-outward direction. Peripheral groove 112 may be formed in an end portion of rotatable valve cylinder 90 in embodiments opposite selector head 92; or, stated differently, such that radial flow passage 124 (and thus the inlet of rotatable valve cylinder 90) is located between selector head 92 and groove 112, as taken along the length of valve cylinder 90 or valve-head piece 94. As noted above and as further shown FIGS. 11 and 12, peripheral groove 112 is not formed as a continuous or complete annular groove extending fully around rotatable valve cylinder 90, but rather extends only partially around an outer circumference of valve cylinder 90. Accordingly, peripheral groove 112 is imparted with first and second terminal ends, which contact non-threaded shaft portion 110 of retention pin 104 when rotatable valve cylinder 90 is rotated fully into the first position and into the second position. The terminal ends of peripheral groove 112 cooperate with non-threaded shaft portion 110 of retention pin 104 to provide a hard stop, which mechanically prevents rotation of rotatable valve cylinder 90 beyond the first and second positions. Thus, in such embodiments, the first and second positions represent rotational extremes of rotatable valve cylinder 90, which further ensures proper positioning of valve cylinder 90 when manually turned by a firearm operator interacting with selector head 92. The likelihood of improper valve positioning within MM gas block 22 is consequently reduced, if not essentially eliminated through the provision of such detent and hard stop features. Concurrently, MM gas block 22 remains amenably to rapid disassembly by a firearm operator by, for example, enabling the firearm operator to remove valve-head piece 94 and detent features 98, 100 after initially unscrewing or otherwise removing threaded retention pin 104 from cavity 106 accessible from the backface of gas block body 64.

CONCLUSION

There has thus been provided embodiments of a multimodal (MM) gas block, which is manually switchable between an unsuppressed mode and at least one suppressed mode of operation. When placed in the suppressed mode, the MM gas block provides controlled venting of return gas flow conducted through the gas block to alleviate suppressor-induced increases in peak pressures and gas flow rates, thereby reducing component wear and minimizing or eliminating any increase in recoil forces imparted to the firearm operator when discharging the suppressed firearm. The gradual accumulation of contamination within the GPO firearm, which may otherwise occur in conjunction with usage of a conventional gas block and suppressor, may also be reduced in conjunction with limited venting of the return gas flow when the MM gas block operates in the vented suppression mode. Further, the fraction of the return gas flow vented to atmosphere may be expelled through an exhaust port formed in a sidewall portion of the gas block body and angled to direct the vented gas flow in a laterally-outward and forward direction. Comparatively, when switched into the unsuppressed mode by an operator, embodiments of the MM gas route all or substantially all return gas flow to the gas piston cylinder to enable operation of the GPO firearm in a typical manner and at optimal flow rates and gas pressures. Further, in at least some embodiments, the MM gas block may incorporate a valve element, such as a rotatable valve cylinder, which blocks the return gas flow into the valve element cavity when the valve element is moved into a position corresponding to the unsuppressed mode of the MM gas block, with the valve element further configured (e.g., through the provision of a flow path notch countered to provide a substantially stepless or smooth transition in flow guidance surfaces when rotated into alignment with the primary flow return path of the gas block) to provide minimal, if any additional resistance to the gas flow through a primary gas return path.

Embodiments of the MM gas block are utilized in conjunction with a GPO firearm including a gas piston, a gas piston cylinder in which the gas piston translates, and a firearm barrel having a (e.g., topside) barrel bleed port. In certain implementations, the MM gas block may include a gas block body, a valve element cavity formed in the gas block body, and a gas inlet port through which the valve element cavity is fluidly coupled to the barrel bleed port when the MM gas block is installed on the GPO firearm. A gas exhaust port is fluidly coupled to the valve element cavity, while a gas return port fluidly couples or connects the valve element cavity to an inlet of the gas piston cylinder when the MM gas block is installed on the firearm. A valve element is at least partly housed within the valve element cavity. The valve element is movable (e.g., via rotation or translation) between: (i) a first position in which the valve element blocks gas flow from the gas inlet port to the gas exhaust port; and (ii) a second position in which the valve element divides or splits gas flow received at the gas inlet port between the gas return port and the gas exhaust port to reduce peak pressures acting on the gas piston when the firearm is discharged, while a suppressor is attached to the firearm barrel.

In at least some implementations, the valve element may assume the form a rotatable valve cylinder disposed within the valve element cavity for rotation between the first and second positions. In such implementations, the MM gas block may also include a manual interface or "mode selector switch," which enables operator switching of the MM gas block between unsuppressed and suppressed modes by rotation of the rotatable valve cylinder into the first and second positions, respectively. When provided, the mode selector switch may assume the form of an enlarged, disc-shaped selector head having an inner face joined to the rotatable valve cylinder and having an outer face accessible from an exterior of the MM gas block. In this manner, the selector head facilitates manual turning of the rotatable valve cylinder by an operator utilizing the operator's fingers, a specialized tool, or another object, such as the casing rim of magazine cartridge compatible with the GPO firearm on which the MM gas block is installed. In still further implementations, the MM gas block may include at least a first flow channel formed in the valve element, with the valve element blocking gas flow from entering the first flow channel when the valve element is rotated or otherwise moved into the first position. Finally, in at least some embodiments, the gas block body includes: (i) a first sidewall having a generally cylindrical opening through which the valve element is in inserted into the valve element cavity, and (ii) a second sidewall laterally opposite the first sidewall and through which the gas exhaust port is formed, with the gas exhaust port beneficially angled to direct exhausted gas flow in a generally forward and lateral-outward direction.

Embodiments of a GPO firearm equipped with a MM gas block have been further provided. In at least some embodiments, the GPO firearm includes an elongated barrel having a barrel bleed port (e.g., formed through an upper wall or surface of the barrel), a gas piston cylinder located adjacent (e.g., positioned generally above) and extending substantially parallel with the barrel, a gas piston slidably disposed in the gas piston cylinder, and the above-mentioned MM gas block. The MM gas block includes, in turn, a gas exhaust port, a gas inlet port fluidly coupled to the barrel bleed port, and a gas return port fluidly coupled to an inlet of the gas piston cylinder. The MM gas block is structurally configured for operation in: (i) an unsuppressed mode in which the MM gas block directs substantially all gas flow received through the gas inlet port to the inlet of the gas piston cylinder when the firearm is discharged; and (ii) a suppressed mode in which the MM gas block directs a first fraction of gas flow received through the gas inlet port to the inlet of the gas piston cylinder when the firearm is discharged, while venting a second (e.g., lesser) fraction of the gas flow to atmosphere (the firearm's surrounding environment) through the gas exhaust port.

In certain implementations, the MM gas block further includes a gas block body in which a valve element cavity is formed, as well as a valve element positioned in the valve element cavity for movement between first and second positional extremes corresponding to the unsuppressed and suppressed modes, respectively. In such implementations, the valve element may assume the form of a rotatable valve cylinder rotatable about the its centerline between the first and second positional extremes, while the MM gas block further includes an enlarged (e.g., disc-shaped) selector head joined to the rotatable valve cylinder and accessible from an exterior of the MM gas block to enable manual turning of the selector head and the rotatable valve cylinder. The MM gas block may also include a restricted orifice formed in the rotatable valve cylinder and sized to limit a peak gas flow rate from the gas inlet port to the gas exhaust port to less than a peak gas flow rate from the gas inlet port to the gas return port when the rotatable valve cylinder resides in the second positional extreme and the firearm is discharged. As a still further possibility, at least one flow channel may be formed in the valve element and oriented such that the valve element blocks gas flow from entering the at least one flow channel when the valve element is rotated into or otherwise moved into the first positional extreme corresponding to the unsuppressed mode of operation.

Terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements. While at least one example embodiment has been presented in the foregoing Detailed Description, it should be appreciated that a vast number of variations exist. It should also be appreciated that the example embodiment or example embodiments are only examples, and are not intended to limit the scope, applicability, or configuration of the invention in any way. Rather, the foregoing Detailed Description will provide those skilled in the art with a convenient road map for implementing an example embodiment of the invention. Various changes may be made in the function and arrangement of elements described in an example embodiment without departing from the scope of the invention as set-forth in the appended Claims.

What is claimed is:

1. A multi-modal gas block utilized in conjunction with a firearm including a gas piston, a gas piston cylinder in which the gas piston translates, and a firearm barrel having a barrel bleed port, the multi-modal gas block comprising:

a gas block body, comprising:

a valve element cavity;

a gas inlet port through which the valve element cavity is fluidly coupled to the barrel bleed port when the multi-modal gas block is installed on the firearm;

a gas exhaust port fluidly coupled to the valve element cavity;

a gas return port fluidly coupling the valve element cavity to an inlet of the gas piston cylinder when the multi-modal gas block is installed on the firearm; and a primary gas return path fluidly coupling the gas inlet port to the gas return port;

a rotatable valve cylinder disposed within the valve element cavity for rotation between: (i) a first position in which the rotatable valve cylinder blocks gas flow from the gas inlet port to the gas exhaust port; and (ii) a second position in which the rotatable valve cylinder divides gas flow received at the gas inlet port between the gas return port and the gas exhaust port; and a contoured notch formed in an outer peripheral portion of the rotatable valve cylinder, the contoured notch rotating into alignment with the primary gas return path when the rotatable valve cylinder is rotated into the first position to minimize protrusion of the rotatable valve cylinder into the primary gas return path.

2. The multi-modal gas block of claim 1, wherein the radial flow channel opens to the primary gas return path when the rotatable valve cylinder is rotated into the second position and closes to the primary gas return path when the rotatable valve cylinder is rotated into the first position.

3. The multi-modal gas block of claim 1, further comprising a mode selector switch enabling operator switching of the multi-modal gas block between an unsuppressed mode in which the rotatable valve cylinder is rotated into the first position and a suppressed mode in which the valve element is rotated into the second position.

4. The multi-modal gas block of claim 3, wherein the mode selector switch comprises a selector head having an inner face joined to the rotatable valve cylinder and having an outer face accessible from an exterior of the multi-modal gas block to enable manual turning of the selector head and the rotatable valve cylinder.

5. A firearm, comprising:

a barrel having a barrel bleed port;

a gas piston cylinder located adjacent and extending substantially parallel to the barrel;

a gas piston slidably disposed in the gas piston cylinder; and a multi-modal gas block, comprising:

a gas exhaust port;

a gas inlet port fluidly coupled to the barrel bleed port;

a gas return port fluidly coupled to an inlet of the gas piston cylinder; and a primary gas return path fluidly coupling the gas inlet port to the gas return port;

wherein the multi-modal gas block is operable in: (i) an unsuppressed mode in which the multi-modal gas block directs substantially all gas flow received through the gas inlet port to the inlet of the gas piston cylinder when the firearm is discharged; and (ii) a suppressed mode in which the multi-modal gas block directs a first fraction of gas flow received through the gas inlet port to the inlet of the gas piston cylinder when the firearm is discharged, while venting a second fraction of the gas flow to atmosphere through the gas exhaust port; and wherein the multi-modal gas block further comprises:

a gas block body in which a valve element cavity is formed; and a valve element positioned in the valve element cavity for movement between first and second positional extremes corresponding to the unsuppressed mode and the suppressed mode, respectively, the valve element including a notch moved into alignment with the primary gas return path when the valve element is moved into the first positional extreme to minimize protrusion of the valve element into the primary gas return path.

6. The firearm of claim 5, wherein the valve element comprises a rotatable valve cylinder rotatable between the first and second positional extremes; and wherein the multi-modal gas block further comprises a selector head joined to the rotatable valve cylinder and accessible from an exterior of the multi-modal gas block to enable manual turning of the selector head and the rotatable valve cylinder.

7. The firearm of claim 6, further comprising a restricted orifice formed in the rotatable valve cylinder and sized to limit a peak gas flow rate from the gas inlet port to the gas exhaust port to less than a peak gas flow rate from the gas inlet port to the gas return port when the rotatable valve cylinder resides in the second positional extreme and the firearm is discharged.

8. The firearm of claim 5, further comprising at least one flow channel formed in the valve element and oriented such that the valve element blocks gas flow from entering the at least one flow channel when the valve element resides in the first positional extreme.

9. A multi-modal gas block utilized in conjunction with a firearm including a gas piston, a gas piston cylinder in which the gas piston translates, and a firearm barrel having a barrel bleed port, the multi-modal gas block comprising:

a gas block body;

a valve element cavity formed in the gas block body;

a gas inlet port through which the valve element cavity is fluidly coupled to the barrel bleed port when the multi-modal gas block is installed on the firearm;

a gas exhaust port fluidly coupled to the valve element cavity;

a gas return port fluidly coupling the valve element cavity to an inlet of the gas piston cylinder when the multi-modal gas block is installed on the firearm; and rotatable valve cylinder disposed within the valve element cavity for rotation between: (i) a first position in which the rotatable valve cylinder blocks gas flow from the gas inlet port to the gas exhaust port; and (ii) a second position in which the rotatable valve cylinder divides gas flow received at the gas inlet port between the gas return port and the gas exhaust port to reduce peak pressures acting on the gas piston when the firearm is discharged, while a suppressor is attached to the firearm barrel;

wherein the rotatable valve cylinder comprises:

an axial flow channel extending along a centerline of the rotatable valve cylinder; and a radial flow channel intersecting the axial flow channel at an angle and positioned such that gas flow travels from the radial flow channel into the axial flow channel before exiting the rotatable valve cylinder when rotated into the second position; and wherein the multi-modal gas block further comprises a restricted orifice formed in the axial flow channel and sized to limit a peak gas flow rate from the gas inlet port to the gas exhaust port to less than a peak gas flow rate from the gas inlet port to the gas return port when the rotatable valve cylinder is rotated into the second position and the firearm is discharged.

10. The multi-modal gas block of claim 9, further comprising a mode selector switch enabling operator switching of the multi-modal gas block between an unsuppressed mode in which the rotatable valve cylinder is rotated into the first position and a suppressed mode in which the valve element is rotated into the second position.

11. The multi-modal gas block of claim 10, wherein the mode selector switch comprises a selector head having an inner face joined to the rotatable valve cylinder and having an outer face accessible from an exterior of the multi-modal gas block to enable manual turning of the selector head and the rotatable valve cylinder.

12. The multi-modal gas block of claim 11, further comprising a slot formed in the outer face of the selector head, the slot sized and shaped to enable operator turning of the selector head utilizing a casing rim of a magazine cartridge compatible with the firearm.

13. The multi-modal gas block of claim 11, further comprising at least one detent feature contained in the gas block body and acting on the selector head or the rotatable valve cylinder to impede rotation of the rotatable valve cylinder from the first position and from the second position.

14. The multi-modal gas block of claim 9, further comprising:

a peripheral groove extending at least partially about an outer circumference of the rotatable valve cylinder; and a retention pin engaged into the peripheral groove to retain the rotatable valve cylinder within the valve element cavity, while permitting rotation of the rotatable valve cylinder between the first position and the second position.

15. The multi-modal gas block of claim 14, wherein the peripheral groove has first and second terminal ends, which contact the retention pin with rotation of the rotatable valve cylinder to provide a hard stop preventing rotation of the rotatable valve cylinder beyond the first position and the second position, respectively.

16. The multi-modal gas block of claim 9, further comprising a primary gas return path fluidly coupling the gas inlet port to the gas return port;

wherein the radial flow channel is opened to the primary gas return path when the rotatable valve cylinder is rotated into the second position and closed to the primary gas return path when the rotatable valve cylinder is rotated into the first position.

17. The multi-modal gas block of claim 16, further comprising a contoured notch formed in an outer peripheral portion of the rotatable valve cylinder, the contoured notch rotating into alignment with the primary gas return path when the rotatable valve cylinder is rotated into the first position to minimize protrusion of the rotatable valve cylinder into the primary gas return path.

18. The multi-modal gas block of claim 9, wherein the gas exhaust port is formed in a side portion of the gas block body and angled to discharge gas flow in a generally forward and lateral-outward direction.

19. The multi-modal gas block of claim 9, further comprising at least a first flow channel formed in the rotatable valve cylinder, the valve element blocking gas flow from entering the first flow channel when the rotatable valve cylinder is rotated into the first position.

20. The multi-modal gas block of claim 9, wherein the gas block body comprises:

a first sidewall having an opening through which the rotatable valve cylinder is in inserted into the valve element cavity; and a second sidewall opposite the first sidewall and through which the gas exhaust port is formed.

* * * * *